US005184948A

United States Patent [19]

Iwahori

[11] Patent Number: 5,184,948

[45] Date of Patent: Feb. 9, 1993

[54] SAFETY MECHANISM FOR A LIGHTER

[76] Inventor: Masayuki Iwahori, 15-19, Nakada Honmachi Shizuoka-shi, Shizuoka-ken, Japan

[21] Appl. No.: 879,994

[22] Filed: May 8, 1992

[30] Foreign Application Priority Data

Oct. 17, 1991 [JP] Japan ..... 3-298466

[51] Int. Cl.[5] ..... F23D 11/36

[52] U.S. Cl. ..... 431/153; 431/276

[58] Field of Search ..... 431/153, 277, 276

[56] References Cited

U.S. PATENT DOCUMENTS 5,090,893 2/1992 Floriot ..... 431/153

FOREIGN PATENT DOCUMENTS 3501647 4/1991 Japan .

*Primary Examiner*—Carroll B. Dority

*Attorney, Agent, or Firm*—Harrison & Egbert

[57] ABSTRACT

A safety mechanism for a lighter which mechanism makes it difficult for infants or children to create a fire with the lighter. The safety mechanism is simple in construction, reliable and acceptable for the proper user of the lighter. The safety mechanism comprises a safety member disposed under a rear portion of a gas lever, said safety member being made of an elastic material in one body, said safety member comprising a frame discontinuous at a rear portion thereof, the discontinuity of the rear portion of said frame being formed by a first movable end and a second movable end, said frame being provided on the inside near said first movable end with an engagement projection, said second movable end normally being positioned just at the back of said engagement projection on the inside of same frame, said frame being provided on the outside near said second movable end with an operation projection protruding backward, said second movable end being adapted to engage with said engagement projection when said operation projection is pushed substantially forward, said gas lever having a projection protruding downward, said projection of the gas lever being positioned over said second movable end of said safety member when said second movable end is positioned just at the back of said engagement projection on the inside of said frame, said gas lever being provided on a lower portion thereof with an inclined portion, said inclined portion pushing said first movable end away from said second movable end when the rear portion of said gas lever is pushed downward.

1 Claim, 3 Drawing Sheets

FIG. 4
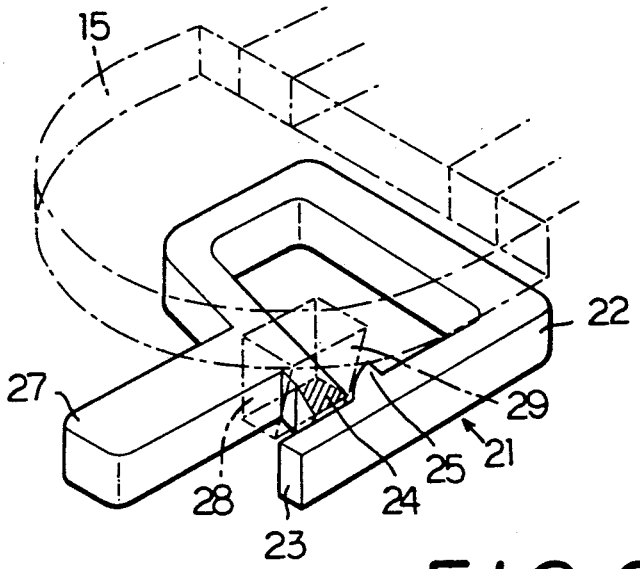
FIG. 6 (1)
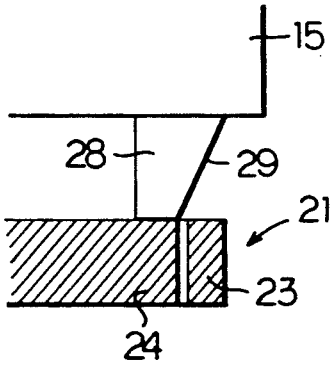
FIG. 6 (2)
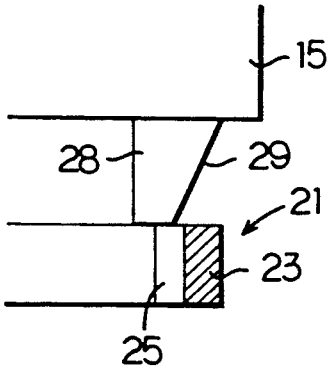
FIG. 6 (3)
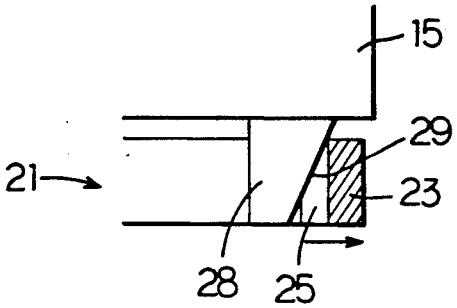

(1)

(2)

PRIOR ART

SAFETY MECHANISM FOR A LIGHTER

BACKGROUND OF THE INVENTION (1) Field of the Invention

The present invention relates to a safety mechanism for a lighter for cigarettes, cigars, etc. More particularly, it relates to a safety mechanism for a lighter which mechanism makes it difficult for infants or children to create a fire with the lighter.

(2) Description of the Prior Art

A lighter designed to make a fire by an easy operation is desirable for the proper user of the lighter. However, such a lighter is very dangerous when it has come into the hands of infants or children who do not recognize the danger of the lighter. Such infants or children may create a fire with the lighter and get burnt or cause an accidental fire.

In view of the above, Japanese Patent Laid-Open Publication No. Hei 3-501647 (PCT/FR89/00339, WO90/00239) provides a safety mechanism which makes it difficult for infants or children to create a fire with a lighter. As shown in FIG. 7, this safety mechanism comprises a gas lever 1 (A lever for pulling up a gas emission nozzle. When the rear portion of the gas lever 1 is pushed downward, the gas emission nozzle is pulled upward thereby and emits gas.) provided in its rear side wall 2 with a horizontal opening 3 having a certain angular range, a notch 4 cut upward into one end of said opening 3, a stop lever 5 horizontally rotatably disposed under said gas lever 1, one end of said stop lever 5 protruding from said opening 3. When the stop lever 5 is in an unlocked position, which is a position under the notch 4 of said opening 3, as shown in FIG. 7 (1), the gas lever 1 is allowed to turn downward. When the stop lever 5 is in a locked position, which is any position in said opening 3 other than said unlocked position, as shown in FIG. 7 (2), the stop lever 5 does not allow the gas lever 1 to turn downward. A spiral spring (not shown) is used as a means for automatically returning the stop lever 5 from the unlocked position to the locked position. In this safety mechanism, the user of the lighter creates a fire when he has turned the stop lever 5 from the locked position to the unlocked position against the force of the spiral spring.

However, the safety mechanism described above has the disadvantages that it is complicated in construction and does not work with sufficient reliability.

BRIEF SUMMARY OF THE INVENTION

It is therefore an object of the invention to provide a safety mechanism for a lighter which mechanism has a simple construction.

It is another object of the invention to provide a safety mechanism for a lighter which mechanism has sufficient reliability of operation.

It is a further object of the invention to provide a safety mechanism for a lighter which mechanism minimizes the possibility that infants or children can create a fire with the lighter and at the same time is acceptable for the proper user of the lighter.

These and other objects have been attained by a safety mechanism for a lighter, which mechanism comprises a safety member disposed under a rear portion of a gas lever, said safety member being made of an elastic material in one body, said safety member comprising a frame discontinuous at a rear portion thereof, the discontinuity of the rear portion of said frame being formed by a first movable end and a second movable end, said frame being provided on the inside near said first movable end with an engagement projection, said second movable end normally being positioned just at the back of said engagement projection on the inside of said frame, said frame being provided on the outside near said second movable end with an operation projection protruding backward, said second movable end being adapted to engage with said engagement projection when said operation projection is pushed substantially forward, said gas lever having a projection protruding downward, said projection of the gas lever being positioned over said second movable end of said safety member when said second movable end is positioned just at the back of said engagement projection on the inside of said frame, said gas lever being provided on a lower portion thereof with an inclined portion, said inclined portion pushing said first movable end away from said second movable end when the rear portion of said gas lever is pushed downward.

In the specification and claim of the present patent application, "forward" means "toward the left" in FIG. 1, "backward" meaning "toward the right" in FIG. 1, "rear" and "back" respectively meaning "right" in FIG. 1.

The operation of the safety mechanism for a lighter according to the present invention will now be described.

When the lighter is not used, said second movable end of the safety member is positioned just at the back of said engagement projection on the inside of the frame. At this time, said downward projection of the gas lever is positioned over said second movable end of the safety member. Therefore, even if the user of the lighter tries to push the rear portion of the gas lever downward, the projection of the gas lever contacts the upper surface of said second movable end and therefore the gas lever does not move downward any more. This means that the gas lever is in a locked state when the lighter is not used.

When the lighter is to be used, the operation projection protruding backward from the external surface of the frame is pushed substantially forward and then the same igniting operation as in conventional lighters is made. When the operation projection is pushed substantially forward, said second movable end moves forward and engages with said engagement projection. When the second movable end is engaged with the engagement projection, the second movable end is in a position (unlocking position) away from the downward projection of the gas lever. Then the gas lever is in an unlocked state and can be turned downward. Now it is possible to create a fire by the same operation as in conventional lighters having no safety mechanism. When the gas lever is pushed downward in the igniting operation, said inclined portion in the lower portion of the gas lever pushes said first movable end away from the second movable end. Therefore, the second movable end is disengaged from the engagement projection near the first movable end and returns to the original position (locking position) just at the back of the engagement projection on the inside of the frame.

Thus, in the lighter having the safety mechanism of the present invention, the gas lever is usually locked. In order to make a fire, it is necessary to unlock the gas lever by pushing the operation projection substantially forward and then make the same igniting operation as in conventional lighters. This two-step operation makes it difficult for infants or children to create a fire with the lighter having the safety mechanism of the present invention. When the gas lever is pushed downward in the igniting operation, the gas lever automatically returns to the original locked state.

The safety mechanism for a lighter according to the present invention has a simple construction and sufficient reliability of operation. Furthermore, the safety mechanism of the present invention is acceptable for the proper user of the lighter.

DESCRIPTION OF THE DRAWINGS

FIG. 4 is a perspective view showing the relationship between said safety member in said locking position and a projection of a gas lever.

FIG. 6(1), FIG. 6(2) and FIG. 6(3) are schematic illustrations showing the relationship between said safety member and said projection of the gas lever.

DETAILED DESCRIPTION

The present invention will now be described in detail with reference to the attached drawings.

Figure 1:
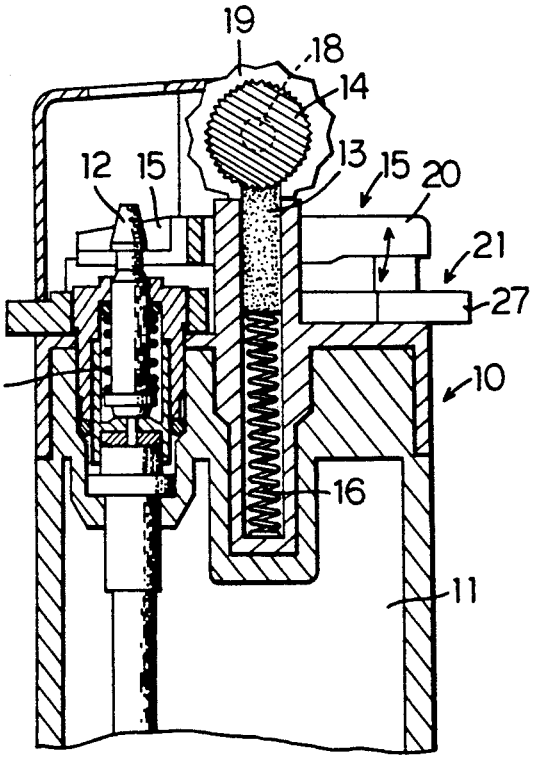
FIG. 1 is a sectional view of a lighter having a safety mechanism of the present invention.
Figure 2:
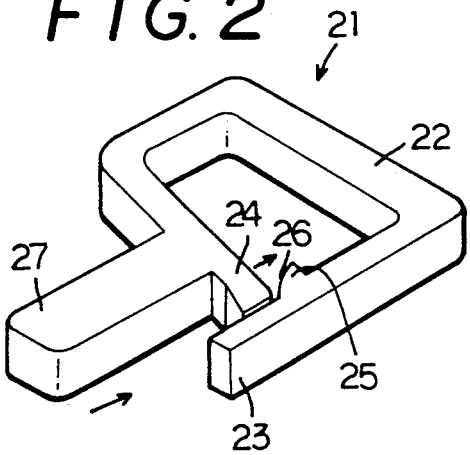
FIG. 2 is a perspective view of a safety member in a locking position.
Figure 3:
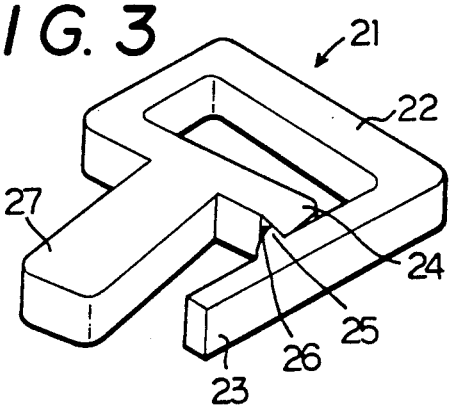
FIG. 3 is a perspective view of said safety member in an unlocking position.
Figure 5:
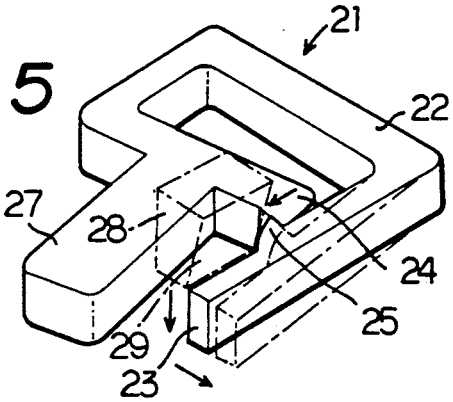
FIG. 5 is a perspective view showing the relationship between said safety member in said unlocking position and said projection of the gas lever.
Figure 7:
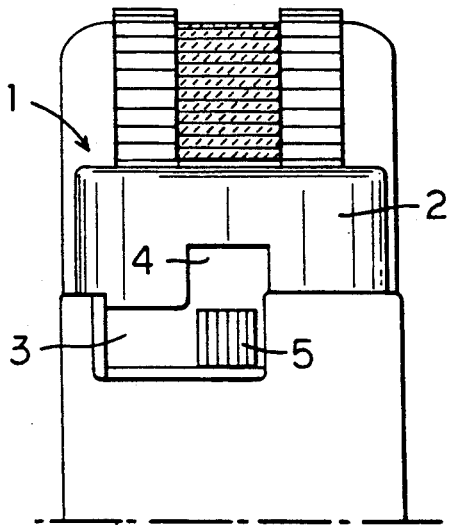
FIG. 7(1) and FIG. 7(2) are rear views showing a conventional safety mechanism.
Figure 7:
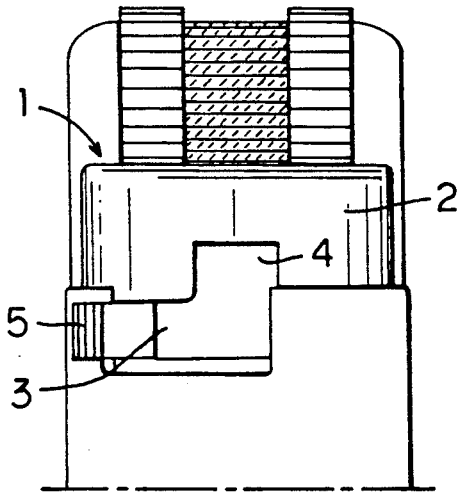
PRIOR ART FIG. 7

A lighter in which a safety mechanism of the present invention is incorporated will be described first with reference to FIG. 1. This lighter comprises a lighter body 10, a fuel well 11 disposed within said lighter body 10, a gas nozzle 12 through which fuel in said fuel well 11 is emitted, a flint 13, a striker wheel 14 in contact with said flint 13, a gas lever 15 for raising said gas nozzle 12 to emit fuel, a compression spring 16 pushing said flint 13 upward against said striker wheel 14, and a return spring 17 for returning said gas nozzle 12 from a raised position. Reference numeral 18 represents a shaft of the striker wheel 14, and reference numeral 19 represents an auxilliary wheel provided on each of the two sides of said striker wheel 14. The lighter described above makes a fire if the striker wheel 14 is rotated by rotating the auxiliary wheels 19 with the thumb for example and almost simultaneously the rear portion 20 of the gas lever 15 is pushed downward with the same thumb. Then, sparks are emitted by the friction between the flint 13 and the striker wheel 14 and fuel is emitted through the gas nozzle 12 raised by the gas lever 15. Therefore, the fuel catches fire.

Now a safety mechanism of the present invention incorporated in the lighter mentioned above will be described. A safety member 21 made of an elastic material in one body is disposed under a rear portion 20 of a gas lever 15. The safety member 21 is preferably made of a synthetic resin. The safety member 21 comprises a frame 22 which is discontinuous at a rear portion thereof. The discontinuity of the rear portion of said frame 22 is formed by a first movable end 23 and a second movable end 24. The frame 22 is fixed to the lighter body 10, but the first movable end 23 and the second movable end 24 thereof are horizontally movable with respect to the lighter body 10. The frame 22 is provided on the inside near the first movable end 23 with an engagement projection 25. The second movable end 24 is normally positioned just at the back of the engagement projection 25 on the inside of the frame 22. The back side of the engagement projection 25 has an inclined plane 26 along which the second movable end 24 moves smoothly. The frame 22 is provided on the outside near the second movable end 24 with an operation projection 27 protruding backward. The second movable end 24 is adapted to engage with the engagement projection 25 when the operation projection 27 is pushed substantially forward. The gas lever 15 is provided with a projection 28 protruding downward. The projection 28 of the gas lever 15 is positioned over the second movable end 24 when the second movable end 24 is positioned just at the back of the engagement projection 25 on the inside of the frame 22. The gas lever 15 is provided on a lower portion thereof with an inclined portion 29. The inclined portion 29 of the gas lever 15 is adapted to push the first movable end 23 away from the second movable end 24 when the rear portion 20 of the gas lever 15 is pushed downward.

The relationship between the gas lever 15 and the safety member 21 will be described further with reference to FIGS. 2 to 6.

LOCKED STATE

The gas lever 15 is in a locked state when the lighter is not used. The second movable end 24 of the safety member 21 is just at the back of the engagement projection 25 on the inside of the frame 22, and the projection 28 of the gas lever 15 is positioned over the second movable end 24. Even if the user of the lighter tries to push the gas lever 15 downward, the projection 28 of the gas lever 15 contacts the upper surface (hatched portion in FIG. 4) of the second movable end 24 and therefore the gas lever 15 does not move downward any more. In this state, it is impossible to create a fire with the lighter. See FIG. 2, FIG. 4 and FIG. 6 (1).

UNLOCKED STATE

The gas lever 15 is turned into an unlocked state when the lighter is to be used. If the operation projection 27 protruding backward from the frame 22 is pushed substantially forward, the second movable end 24 moves forward and engages with the engagement projection 25. At this time, the second movable end 24 is in a position (unlocking position) away from the projection 28 of the gas lever 15. Then, the gas lever 15 is unlocked and allowed to move downward. In this state, it is possible to create a fire with the lighter. See FIG. 3, FIG. 5 and FIG. 6 (2).

IGNITION

When the gas lever 15 is in said unlocked state, the lighter makes a fire if the striker wheel 14 is rotated by rotating the auxiliary wheels 19 with the thumb for example and almost simultaneously the rear portion 20 of the gas lever 15 is pushed downward with the same thumb. See FIG. 6 (3).

AUTOMATIC RETURN TO LOCKED STATE

When the gas lever 15 is pushed downward in the igniting operation, the inclined portion 29 in the lower portion of the gas lever 15 pushes the first movable end 23 away from the second movable end 24. Therefore, the second movable end 24 is disengaged from the engagement projection 25 near the first movable end 23 and returns to the original position (locking position), shown in FIG. 2 and FIG. 4, just at the back of the engagement projection 25 on the inside of the frame 22. At the same time, the gas lever 15 is returned to the original position by the force of the return spring 17. See FIG. 6 (3).

What is claimed is:

1. A safety mechanism for a lighter comprising a safety member disposed under a rear portion of a gas lever, said safety member being made of an elastic material in one body, said safety member comprising a frame discontinuous at a rear portion thereof, the discontinuity of the rear portion of said frame being formed by a first movable end and a second movable end, said frame being provided on the inside near said first movable end with an engagement projection, said second movable end normally being positioned just at the back of said engagement projection on the inside of said frame, said frame being provided on the outside near said second movable end with an operation projection protruding backward, said second movable end being adapted to engage with said engagement projection when said operation projection is pushed substantially forward, said gas lever having a projection protruding downward, said projection of the gas lever being positioned over said second movable end of said safety member when said second movable end is positioned just at the back of said engagement projection on the inside of said frame, said gas lever being provided on a lower portion thereof with an inclined portion, said inclined portion pushing said first movable end away from said second movable end when the rear portion of said gas lever is pushed downward.

* * * * *